US007295175B2

(12) United States Patent
Hayafuji et al.

(10) Patent No.: US 7,295,175 B2
(45) Date of Patent: Nov. 13, 2007

(54) DEVICE AND METHOD FOR DRIVING FOR LIGHT-EMITTING DISPLAY PANEL

(75) Inventors: Akinori Hayafuji, Yonezawa (JP); Akira Moriya, Yonezawa (JP)

(73) Assignee: Tohoku Pioneer Corporation, Yamagata (JP)

( * ) Notice: Subject to any disclaimer, the term of this patent is extended or adjusted under 35 U.S.C. 154(b) by 8 days.

(21) Appl. No.: 11/367,281

(22) Filed: Mar. 6, 2006

(65) Prior Publication Data

US 2006/0202631 A1 Sep. 14, 2006

(30) Foreign Application Priority Data

Mar. 8, 2005 (JP) ..... 2005-063755

(51) Int. Cl.
*G09G 3/30* (2006.01)
*G09G 3/32* (2006.01)
*G09G 3/10* (2006.01)

(52) U.S. Cl. ..... 345/77; 345/83; 345/212; 315/169.3

(58) Field of Classification Search ..... 315/169.3; 345/204, 211, 212, 76, 77, 82, 83, 84
See application file for complete search history.

(56) References Cited

U.S. PATENT DOCUMENTS 6,707,438 B1 * 3/2004 Ishizuka et al. ..... 345/78
7,109,955 B2 * 9/2006 Ishizuka et al. ..... 345/76
2004/0150594 A1 * 8/2004 Koyama et al. ..... 345/82
2006/0038501 A1 * 2/2006 Koyama et al. ..... 315/169.3
2006/0055631 A1 * 3/2006 Yoshida ..... 345/46
2006/0139254 A1 * 6/2006 Hayakawa et al. ..... 345/76
2006/0158393 A1 * 7/2006 Fukumoto et al. ..... 345/76

FOREIGN PATENT DOCUMENTS

JP 2003-162255 6/2003

* cited by examiner

*Primary Examiner*—Thuy Vinh Tran
(74) *Attorney, Agent, or Firm*—Westerman, Hattori, Daniels & Adrian, LLP.

(57) ABSTRACT

There is provided a device for driving a light-emitting display panel in which output limiter element is added to a DC-DC converter which associates a boosting operation. In the drive device, even though a forward voltage of a monitor element increases to operate the limiter element, predetermined display quality can be assured without considerably disrupting a color balance. On a display panel, a display region in which display pixels of R, G, and B are arranged and an arrangement region for monitor elements which monitor forward voltages of R, G, and B are formed. Output voltages obtained by the respective DC-DC converters are controlled based on the forward voltages obtained by the monitor elements. An output limiter is constituted by zener diodes to prevent converter output values from being excessive by increases in forward voltages from the monitor elements due to aging. Limiter values obtained by the zener diodes are set at different levels.

12 Claims, 7 Drawing Sheets

DEVICE AND METHOD FOR DRIVING FOR LIGHT-EMITTING DISPLAY PANEL

BACKGROUND OF THE INVENTION

1. Field of the Invention

The present invention relates to a device and a method for driving a light-emitting display panel in which a large number of light-emitting elements which exhibit different emission colors as display pixels to perform full-color display or multi-color display.

2. Description of the Related Art

Along with the popularization of a mobile telephone, a personal digital assistant (PDA), and the like, a demand for a display panel which has a high-definition image display function and can realize a small thickness and a low power consumption increases. As a display panel which satisfies the demand, liquid crystal panels are conventionally applied to a large number of products. On the other hand, in recent years, an organic EL (Electro-Luminescence) element which takes advantage of characteristics of a self-emitting display element is practically used. The display panel draws attention as a next-generation display panel which is replaced with a conventional liquid crystal display panel. This is caused by a background in which an organic compound which can expect preferable light-emitting characteristics is used in a light-emitting function layer of an element to achieve practical high efficiency and practical long life.

The organic EL element, for example, is basically formed such that a transparent electrode consisting of, e.g., ITO, a light-emitting function layer consisting of an organic material, and a metal electrode are sequentially stacked on a transparent substrate such as a glass substrate. The light-emitting function layer may be a single layer consisting of an organic light-emitting layer, a two-layer structure consisting of an organic hole transportation layer and an organic light-emitting layer, a three-layer structure consisting of an organic hole transportation layer, an organic light-emitting layer, and an organic electron transportation layer, or a multi-layer structure obtained by inserting an electron or hole-implanted layer between these appropriate layers.

The organic EL element can be electrically expressed by an equivalent circuit as shown in FIG. 1. More specifically, the organic EL element can be electrically replaced with a configuration constituted by a diode component E serving as a light-emitting element and a parasitic capacitive component Cp coupled in parallel to the diode component E. The organic EL element is considered as a capacitive light-emitting element.

When a light-emitting drive voltage is applied to the organic EL element, first, electric charges corresponding to the electric capacitance of the element flow into the electrode as a displacement current and are accumulated in the electrode. Subsequently, when the voltage exceeds a predetermined voltage (light-emitting threshold voltage=Vth) inherent in the element, a current begins to flow from one electrode (anode side of the diode component E) to the organic layer constituting the light-emitting layer. It can be understood that light emission occurs with an intensity which is in proportion to the current.

FIGS. 2A to 2D show light-emitting static characteristics of such an organic EL element. According to this, the organic EL element, as shown in FIG. 2A, emission occurs with a luminance L which is appropriately proportional to a drive current I. As indicated by a solid line in FIG. 2B, a drive voltage V is equal to or higher than an emission threshold voltage Vth, the current I rapidly flows to emit light.

In other words, when the drive voltage is equal to or lower than the emission threshold voltage Vth, a current rarely flows in the EL element, and the EL element does not emit light. Therefore, the EL element has the following luminance characteristic. That is, as indicated by a solid line in FIG. 2C, in an emittable region in which the drive voltage is larger than the threshold voltage Vth, as the voltage V applied to the EL element increases, an emission luminance L increases.

On the other hand, it is known that the organic EL element has physical properties which change in long-termuse to increase a forward voltage Vf. For this reason, In the EL element, as shown in FIG. 2B, a V-I (L) characteristic changes in a direction indicated by an arrow (characteristic indicated by a brokenline) depending on actual operating time. Therefore, the luminance characteristic also decreases.

Furthermore, it is known that the luminance characteristic generally changes as indicated by a broken line in FIG. 2C depending on a temperature. More specifically, the EL element has the following characteristics. That is, in an emittable region in which the drive voltage is larger than the emission threshold voltage, as the voltage V applied to the EL element increases, the emission luminance L of the EL element increases. However, the temperature increases, the emission threshold voltage decreases. Therefore, a minimum applied voltage with which the EL element is set in an emittable state decreases as the temperature increases. Even though a predetermined emittable applied voltage is given, the EL element is bright at a high temperature and dark at a low temperature. That is, the luminance is dependent on temperature.

In addition, the EL elements disadvantageously have luminous efficiencies to a drive voltage which change depending on emission colors. As the luminous efficiencies of EL elements which can be practically used and emit R (Red), G (Green), and B (Blue) lights, in an early stage, as generally shown in FIG. 2D, the emission efficiency of G is high, and the emission efficiency of B is the lowest. Each of the EL elements which emit R, G, and B lights has an aging characteristic and a temperature dependence as shown in FIGS. 2B and 2C.

Therefore, when EL elements which emit R, G, and B lights are arranged to try to perform, e.g., full-color display, a color balance is disrupted due to a change in environment temperature or aging, and display quality cannot be easily held at a predetermined level. In particular, in a drive device for an active matrix display panel having a configuration in which EL elements are driven at a constant voltage by switching operations of TFTs, as indicated by V-I (L) characteristics shown in FIGS. 2A to 2D, an emission luminance largely varies with a variation of the forward voltage Vf of each element to pose a problem of considerable deterioration of display quality.

For this reason, in order to solve the above problem, monitor elements which monitor the forward voltages Vf of the EL elements which emit R, G, and B lights are prepared. A device for driving a light-emitting display panel in which drive voltages applied to the EL elements which emits the color lights are independently controlled based on the forward voltages Vf obtained by the monitor elements is disclosed in Japanese Unexamined Patent Publication No. 2003-162255.

As described above, when the display device designed to independently control drive voltages applied to display EL elements which emit R, G, and B lights is employed in, e.g., a mobile device, a battery voltage serving as a primary power supply is boosted to be given to the display EL elements of the respectively colors.

In this case, as means which boosts the battery voltage serving as the primary power source, a DC-DC converter constituted by a switching regulator is generally used. When the DC-DC converter is used, an operation which uses forward voltages Vf obtained by monitor elements corresponding to R, G, and B as control voltages and boosts drive voltages applied to display EL elements based on the control voltages is executed. For this reason, even though the forward voltages change due to aging or temperature dependence of the elements, the relationship among optimum drive voltages well-balanced with respect to R, G, and B can be maintained.

On the other hand, in the configuration, when the control voltages of the DC-DC converter increase under any fault, or when the circuit which supplies the control voltage is set in an open state due to any fault, an output voltage from the DC-DC converter considerably increases to damage not only the pixels arranged on the display panel but also driver circuits or the like which luminescently control the pixels.

Therefore, when the boosting DC-DC converter is used, a voltage limiter which suppresses the output voltage of the converter from excessively increasing due to an unexpected situation must be simultaneously used. When the voltage limiter is used together with the converter as described above, a configuration in which zener diodes functioning as voltage limiters are connected to control voltage input terminals of the DC-DC converters corresponding to R, G, and B, respectively can be preferably employed.

As has been described above, the forward voltages of the monitor elements corresponding to R, G, and B gradually increase due to aging. Therefore, as described above, in the DC-DC converters which are used together with the voltage limiters, when the forward voltage of any one of the monitor elements corresponding to R, G, and B reaches a forward voltage at which the corresponding voltage limiter operates, a drive voltage corresponding to the monitor element is regulated, and the relationship among the optimum drive voltages corresponding to the characteristics of R, G, and B cannot be maintained.

Subsequently, because the degree of aging further advances, it is more and more impossible to obtain the relationship among optimum drive voltages. Therefore, a color balance (white balance) is kept disrupted. Recovery of the color balance is difficult.

FIG. 3 is to explain the above situation. Reference symbols R, G, and B in FIG. 3 indicate characteristics of the monitor elements corresponding to the respective colors described above. An abscissa (T) indicates elapsed time, and an ordinate (V) indicates a forward voltage of the monitor element. In the example shown in FIG. 3, for example, aging of the monitor element corresponding to B advances, the forward voltage of the monitor element is first to reach a forward voltage Vf1 at which the voltage limiter operates. Elapsed time until this is represented by T1 for descriptive convenience.

More specifically, until the time T1, the output voltages of the converters are controlled by the forward voltages of the monitor elements corresponding to R, G, and B, respectively. For this reason, the color balance (white balance) can be maintained. However, after the time T1, the output voltage from the converter corresponding to B is limited to a limiter operation. For this reason, the color balance on the display panel is disrupted.

In the example shown in FIG. 3, the limiter levels corresponding to R, G, and B are equal to each other. Therefore, when time has further elapsed, the forward voltage of the monitor element corresponding to R secondly reaches the voltage Vf1 to operate the limiter. Finally, the forward voltage of the monitor element corresponding to G reaches the voltage Vf1 to operate the limiter.

In this manner, in the situation in which the limiter functions corresponding to R, G, and B operate, the drive voltages applied to the display elements are approximately equal to each other. For this reason, the color balance (white balance) is kept disrupted due to difference of light-emitting efficiencies of R, G, and B. The color balance cannot be recovered.

SUMMARY OF THE INVENTION

The invention has been made based on the above technical background, and an object of the invention is to provide a device and a method for driving a light-emitting display panel in which, in a configuration obtained by adding output limiter means to a DC-DC converter with a boosting operation, even though a forward voltage of a monitor element increases to operate the limiter means, predetermined display quality can be assured without considerably disrupting a color balance.

A display device for a light-emitting display panel according to the invention to solve the above problem is a device for driving a light-emitting display panel in which a large number of light-emitting elements which exhibit different emission colors are arranged as display elements and selectively luminescently driven to display an image, including: monitor elements of respective colors to measure forward voltages of the light-emitting elements in the display pixels of the colors; drive voltage control means which controls drive voltages supplied to the display pixels of the colors based on the forward voltages obtained by the monitor elements of the colors; and voltage limiter means which regulate the drive voltages from the respective drive voltage control means, and wherein regulation levels of the drive voltages by the voltage limiter means are set at, at least two different values.

A method for driving a light-emitting display panel according to the invention to solve the above problem is a method for driving a light-emitting display panel in which a large number of light-emitting elements which exhibit different emission colors are arranged as display elements and selectively luminescently driven to display an image, including: a forward voltage acquiring step of acquiring voltages corresponding to the forward voltages of the light-emitting elements in the display pixels of the colors by monitor elements arranged for the respective colors; and a drive voltage control step of generating drive voltages supplied to the display pixels of the colors based on the voltages obtained in the forward voltage acquiring step and supplying the drive voltages to the display pixels when the maximum value of the drive voltages supplied to the display pixels of the respective colors are regulated to at least two different levels.

DESCRIPTION OF THE PREFERRED EMBODIMENTS

Figure 4:
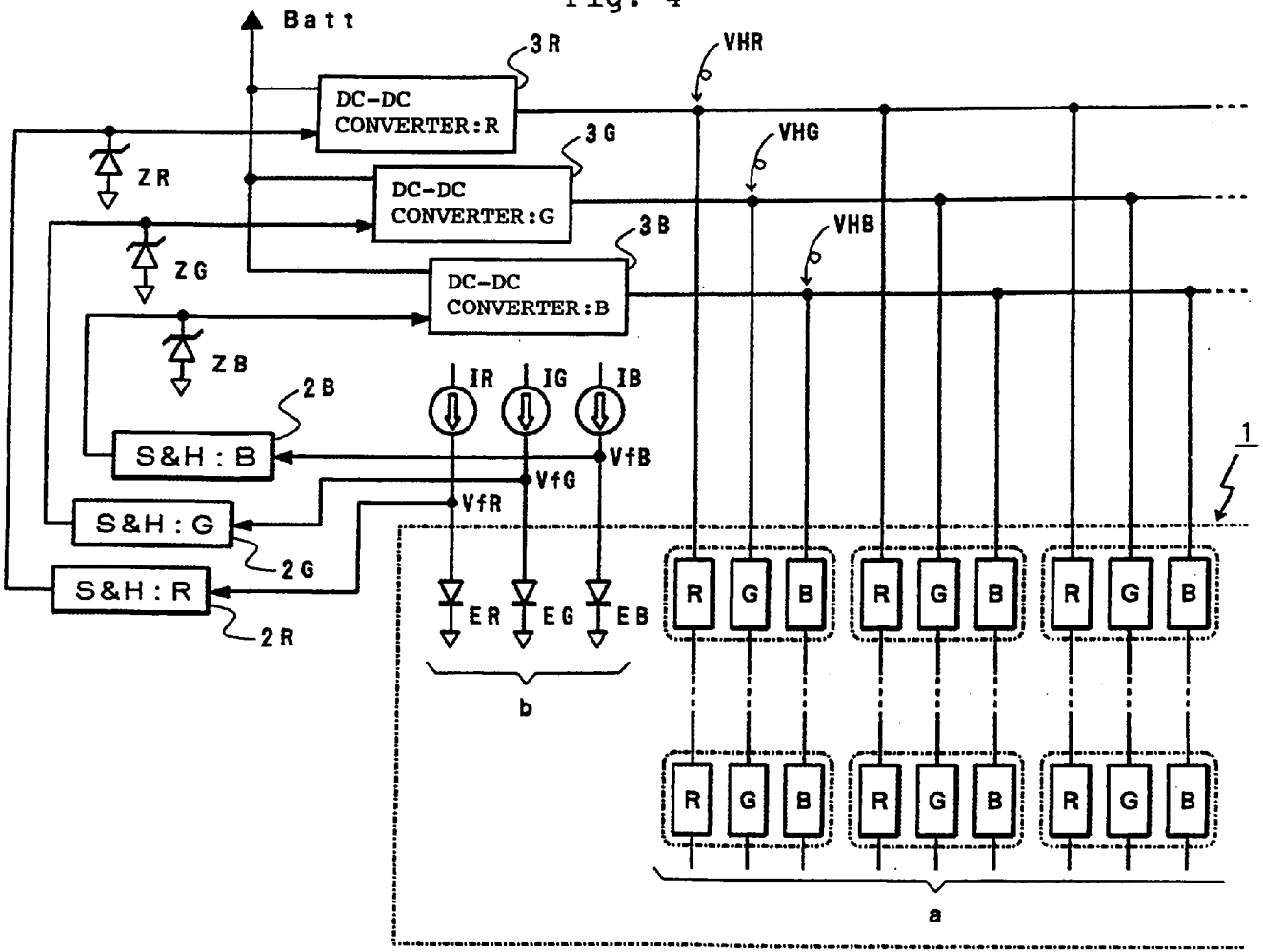
FIG. 4 is a block diagram showing an embodiment of a device for driving according to the present invention.

A device for driving a light-emitting display panel according to the invention will be described below with reference to embodiments shown in the drawings. FIG. 4 shows the basic configuration of the drive device. Reference numeral 1 denotes an active drive light-emitting display panel. Color display pixels including combinations of sub-pixels indicated by R, G, and B and surrounded by a chain line are arranged in the form of a matrix in a display region a on the display panel 1. In FIG. 4, due to limitations of space, only a partial arrangement of the color display pixels is shown.

An arrangement region b for monitor elements is formed in a part of the display panel 1. In the arrangement region b for the monitor elements, organic EL elements ER, EG, and EB serving as monitor elements corresponding to the colors R, G, and B are arranged at the same time as the film forming step of the display region a. A constant current source IR which supplies a constant current to the monitor element ER corresponding to the color R, a constant current source IG which supplies a constant current to the monitor element EG corresponding to the color G, and a constant current source IB which supplies a constant current to the monitor element EB corresponding to the color B are provided respectively.

In addition, a forward voltage VfR generated when a constant current is supplied from the constant current source IR to the monitor element ER is designed to be supplied to a sample hold circuit 2R, and a forward voltage vfG generated when a constant current is supplied from the constant current source IG to the monitor element EG is designed to be supplied to a sample hold circuit 2G. Furthermore, similarly, a forward voltage VfB generated when a constant current is supplied from the constant current source IB to the monitor element EB is designed to be supplied to a sample hold circuit 2B.

The forward voltages VfR, VfG, and VfB held by the sample hold circuits 2R, 2G, and 2B are designed to be supplied to DC-DC converters 3R, 3G, and 3B serving as switching regulators as control voltages, respectively. In this case, zener diodes ZR, ZG, and ZB functioning as voltage limiter means are connected between a reference voltage point and control voltage transmitting lines which connect the sample hold circuits 2R, 2G, and 2B to the DC-DC converters 3R, 3G, and 3B respectively. A relationship among zener voltages of the zener diodes ZR, ZG, and ZB will be described below.

The DC-DC converters 3R, 3G, and 3B function as drive voltage control means which control the values of drive voltages supplied to the display pixels indicated by reference symbols R, G, and B based on the control voltages serving as the forward voltages VfR, VfG, and VfB held by the sample hold circuits 2R, 2G, and 2B, respectively.

More specifically, a drive voltage VHR is output from the converter 3R based on the forward voltage VfR. The drive voltage VHR is supplied to the display pixel indicated by R as a drive voltage. A drive voltage VHG is output from the converter 3G based on the forward voltage VfG. The drive voltage VHG is supplied to the display pixel indicated by G as a drive voltage. Similarly, a drive voltage VHB is output from the converter 3B based on the forward voltage VfB. The drive voltage VHB is supplied to the display pixel indicated by B as a drive voltage. The DC-DC converters 3R, 3G, and 3B functioning as the drive voltage control means constitute a boosting converter using, e.g., a battery as a primary power source as will be described based on FIG. 5.

Figure 5:
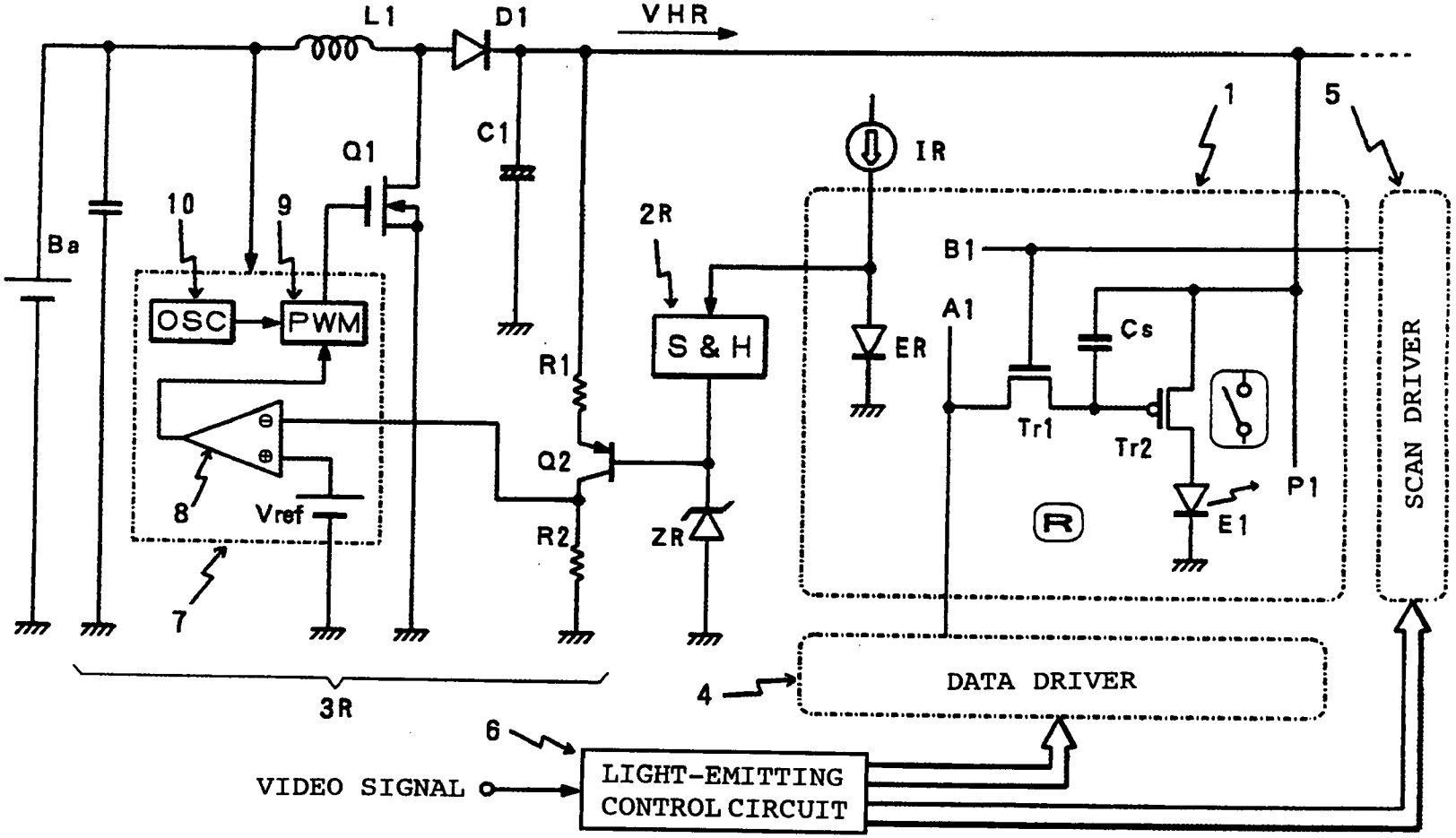
FIG. 5 is a circuit diagram showing a more detailed configuration of a part in FIG. 4.

FIG. 5 shows a more detailed configuration of a display pixel and a DC-DC converter formed on the display panel 1 shown in FIG. 4. In FIG. 5, due to limitations of space, a configuration of a display pixel for R (Red) and a converter which supplies a drive voltage to the display pixel. However, configurations corresponding to the colors G and B can also be shown as the same configuration as that for the color R.

As shown in FIG. 5, a data line A1 to which a data signal from a data driver 4 is supplied is arranged in the vertical direction, and a scan selecting line B1 to which a scan selecting signal from a scan driver 5 is supplied is arranged in the horizontal direction. Furthermore, a power supply line P1 is arranged on the display panel 1 in the direction vertical to the data line. The drive voltage VHR brought by the DC-DC converter 3R is designed to be supplied to the power supply line.

As an example of sub-pixels shown as R on the display panel 1 in FIG. 5, a pixel arrangement obtained by a conductance control scheme is shown. More specifically, the gate of a control transistor Tr1 constituted by an n-channel TFT is connected to a scan selecting line B1, and the source is connected to the data line A1. The drain of the control transistor Tr1 is connected to the gate of a light-emitting drive transistor Tr2 constituted by a p-channel TFT and also connected to one terminal of a charge holding capacitor Cs.

The source of the light-emitting drive transistor Tr2 is connected to the other terminal of the capacitor Cs and connected to the power supply line P1. The anode of an EL element E1 serving as a light-emitting element is connected to the drain of the light-emitting transistor, and the cathode of the EL element E1 is connected to a reference voltage point. In this manner, the sub-pixels having the above configuration, as shown in FIG. 4 constitute color pixels as combinations of sub-pixels corresponding to G and B. The large number of color pixels are arranged in the form of a matrix in the vertical and horizontal directions on the display panel 1.

In the above pixel configuration, when an ON voltage is supplied from a scan driver to the gate of the control transistor Tr1 through the scan selecting line B1, the control transistor Tr1 flows a current corresponding to a data voltage supplied from the data line A1 to the source from the source to the drain. Therefore, in a period in which the gate of the control transistor Tr1 is set at an ON voltage, the capacitor Cs is electrically charged, and the voltage is supplied to the gate of the light-emitting drive transistor Tr2.

Therefore, the light-emitting drive transistor Tr2 is ON-operated based on an inter-gate-source voltage. The drive voltage VHR brought from the DC-DC converter serving as the drive voltage control means is applied to the EL element E1 to luminescently drive the EL element. More specifically, in the embodiment, the light-emitting drive transistor Tr2 constituted by a TFT is designed to perform a binary switching operation (operates in a linear region), i.e., an ON or OFF operation.

On the other hand, when the gate of the control transistor Tr1 is set at an OFF voltage, the transistor is set in a so-called cutoff state. Although the drain of the control transistor Tr1 is set in an open state, the light-emitting drive transistor Tr2 holds the gate voltage by electric charges accumulated in the capacitor Cs. Application of the drive voltage VHR to the EL element E1 is continued until the next scanning, so that the emission of light from the EL element E1 is maintained.

To the data driver 4 and the scan driver 5, pixel drive data, a scan selecting signal, and the like are designed to be supplied from a light-emitting control circuit 6 to which a video signal is input through a data bus.

On the other hand, on the display panel 1, as has been described with reference to FIG. 4, the monitor element ER corresponding to R is arranged. A constant current is supplied from the constant current source IR to the monitor element ER. In this manner, a forward voltage generated by the monitor element ER is held by the sample hold circuit 2R and supplied to the DC-DC converter 3R as a control voltage. The control voltage may be subjected to a limiter operation by the zener diode ZR functioning as voltage limiter means. This operation will be described later in detail.

The DC-DC converter 3R is designed such that a PWM wave output from a switching control circuit 70N-controls a MOS power FET Q1 serving as a switching element in a predetermined duty cycle.

More specifically, by the ON operation of the power FET Q1 accumulates power energy from a battery Ba serving as a primary power source in an inductor L1. With the OFF operation of the power FET Q1, the power energy accumulated in the inductor L1 is accumulated in a capacitor C1 through a diode D1. The ON/OFF operation of the power FET Q1 is repeated to make it possible to obtain a boosted DC output as a terminal voltage of the capacitor C1.

The DC output voltage is divided by a resistor R1, a pnp transistor Q2, and a resistor R2. The divided voltages are supplied to an error amplifier 8 in the switching control circuit 7. In the error amplifier 8, the voltages are compared with a reference voltage Vref. The comparison output (error output) is supplied to a PWM circuit 9, and a duty ratio of signal waves brought by an oscillator 10 is controlled. In this manner, feedback control is performed such that the output voltage is kept at the predetermined drive voltage VHR. Although the above explanation indicates an example obtained by PWM control, a configuration obtained by PFM control is used as a matter of course.

Therefore, the drive voltage VHR obtained by the DC-DC converter can be expressed by the following equation 1 when a resistance between the emitter and collector electrodes of the transistor Q2 is represented by Rq2. More specifically, the drive voltage VHR of the converter is controlled depending on an electric resistance between the emitter and collector electrodes of the transistor Q2.

$$VHR = V\mathrm{ref} \times [(R1 + Rq2 + R2)/R2] \quad \text{(Equation 1)}$$

In this case, a control voltage from the sample hold circuit 2R is designed to be supplied to the base electrode of the transistor Q2. Therefore, the value of the output voltage VHR by the DC-DC converter 3R is controlled depending on the control voltage from the sample hold circuit 2R.

Control operations of the output voltages obtained by the DC-DC converters corresponding to the forward voltages of R, G, and B are independently executed for R, G, and B, respectively. Therefore, with respect to R, G, and B, optimum drive voltages depending on an operation temperature and aging can be supplied to display pixels (sub-pixels), respectively.

Therefore, as has been described above, even in a pixel configuration which is driven by a constant voltage such that the light-emitting drive transistor Tr2 performs a binary switching operation, i.e., an ON or OFF operation by a data voltage supplied from a data driver, light-emitting control is performed by drive voltages depending on forward voltages of R, G, and B. For this reason, preferable temperature compensation and a compensating operation depending on aging can be realized.

Figure 6:
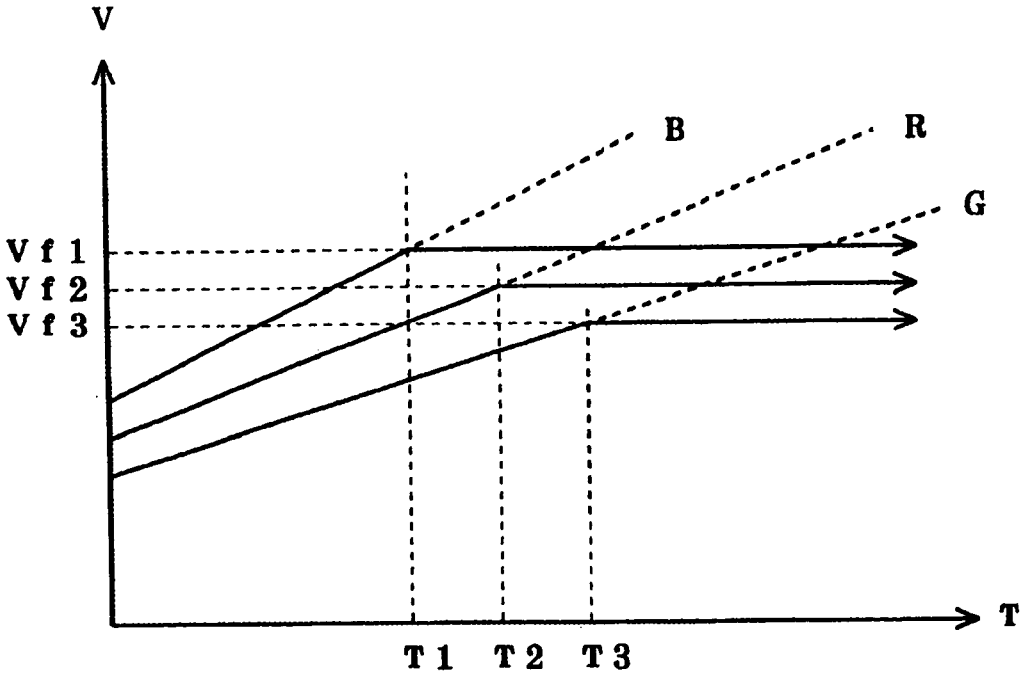
FIG. 6 is a temporal graph for explaining a first voltage limiter operation in a device for driving according to the invention.

FIG. 6 explains operations of the zener diodes ZR, ZG, and ZB functioning as voltage limiter means. The zener diodes are used to suppress an excessive output voltage from being supplied by a boosting DC-DC converter by an unexpected situation. In the embodiment, in addition to the operations described above, regulation levels (limiter levels) of output voltages from the converters are set at different values depending on the light-emitting efficiencies of the EL elements for R, G, and B.

Figure 1:
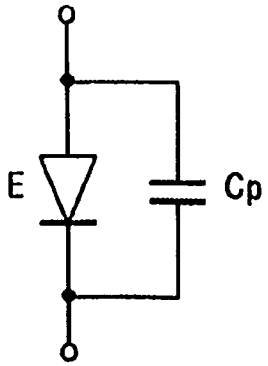
PRIOR ART Fig. 1
FIG. 1 is an equivalent circuit diagram of an organic EL element.
Figure 2A:
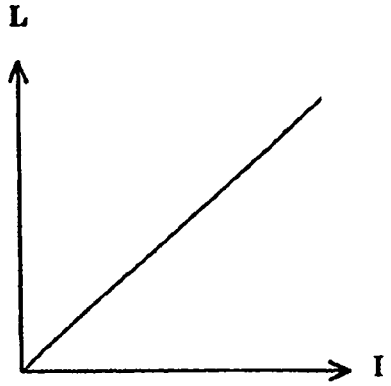
PRIOR ART Fig. 2A
FIGS. 2A to 2D are static graphs showing various characteristics the organic EL element.
Figure 2B:
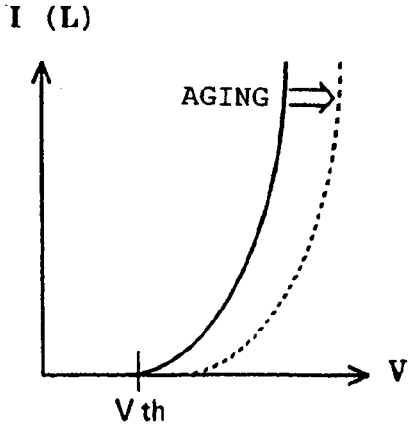
PRIOR ART Fig. 2B
Figure 2C:
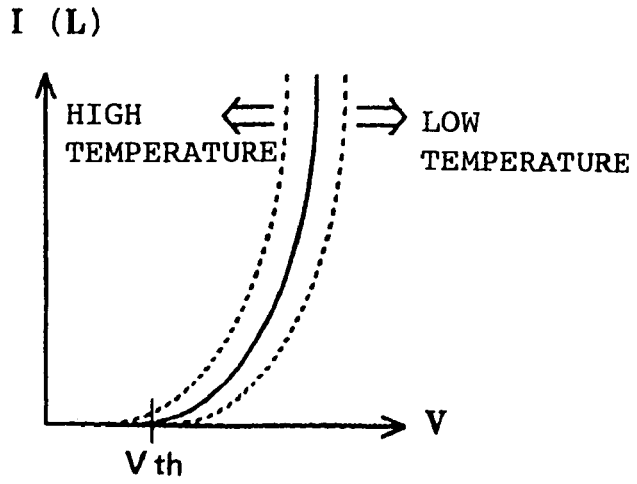
PRIOR ART Fig. 2C
Figure 2D:
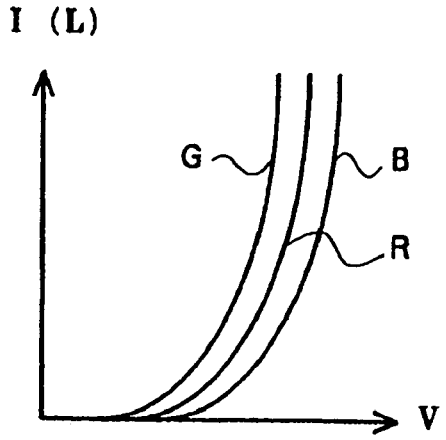
PRIOR ART Fig. 2D
Figure 3:
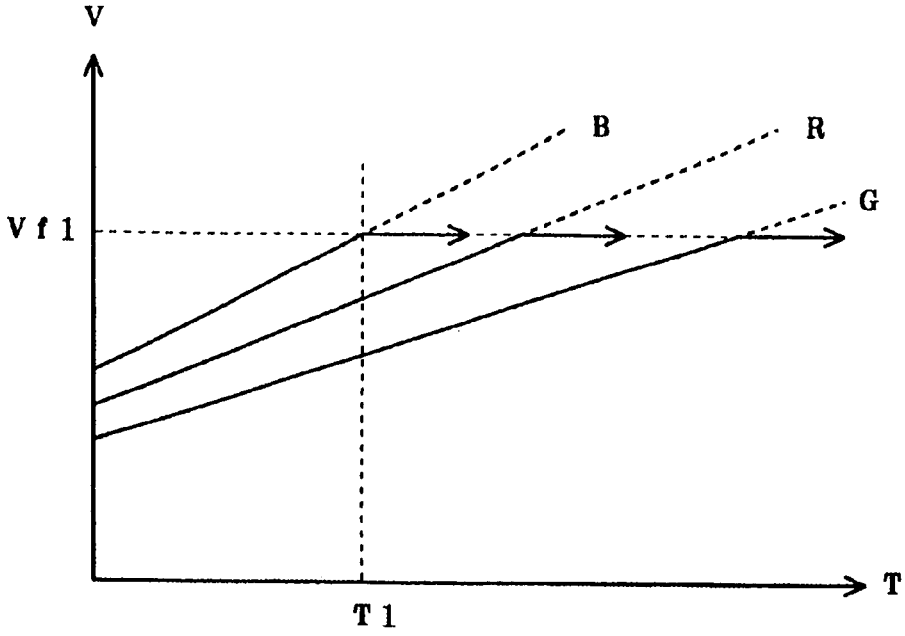
PRIOR ART Fig. 3
FIG. 3 is a temporal graph for explaining a voltage limiter operation in a device for driving with the problem to be solved by the invention.

FIG. 6 shows the same aging characteristic as that of the voltage limiter operation shown in FIG. 3 described above. In a voltage limiter operation by the zener diodes shown in FIG. 6 and corresponding to R, G, and B, the voltage limiters constituted by zener diodes are set to operate depending on a descending order of the forward voltages of R, G, and B.

More specifically, in the example shown in FIG. 6, the zener diode ZB having a zener voltage at which the voltage limiter operates when the forward voltage corresponding to B reaches a voltage Vf1 by aging is employed. Similarly, the zener diode ZR having a zener voltage at which the voltage limiter operates when the forward voltage corresponding to R reaches a voltage Vf2 is employed. Furthermore, the zener diode ZG having a zener voltage at which the voltage limiter operates when the forward voltage corresponding to G reaches a voltage Vf3.

According to the setting of the zener voltages shown in FIG. 6, before time T1 at which the voltage limiter operates, as has been described above, a preferable color balance by the colors R, G, and B can be held. The forward voltages respectively increase due to aging. First, the limiter acts on the drive voltage from the converter corresponding to B at the level of the voltage Vf1. Subsequently, the limiter acts on the drive voltage from the converter corresponding to R at the level of the voltage Vf2. Finally, the limiter acts on the drive voltage from the converter corresponding to G at the level of the voltage Vf3.

According to the operation, after time T1, the voltage limiters are sequentially operated depending on the light-emitting efficiencies of the EL elements of R, G, and B. For this reason, the color balance is not considerably disrupted. Even in a period from time T1 to time T3, luminance compensation corresponding to aging of the entire display panel can be achieved.

Figure 7:
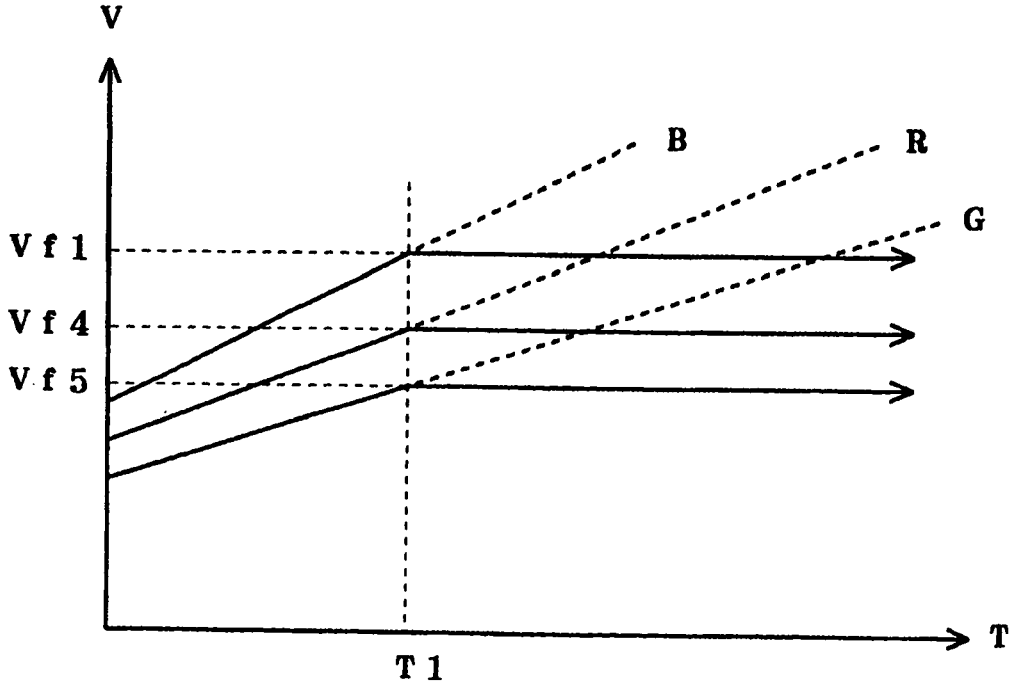
FIG. 7 is a temporal graph for explaining a second voltage limiter operation in the drive device.

On the other hand, FIG. 7 explains the setting of other voltage limiters corresponding to R, G, and B. In the example shown in FIG. 7, zener diodes having zener voltages corresponding to the forward voltages of R, G, and B are used at time T1. More specifically, as the zener diode corresponding to B, a zener diode having a zener voltage corresponding to the voltage Vf1 is used. As the zener diode corresponding to R, a zener diode having a zener voltage corresponding to a voltage Vf4 is used. Furthermore, as the zener diode corresponding to G, a zener diode having a zener voltage corresponding to a voltage Vf5 is used.

According to a combination of the zener diodes, after time T1, luminance compensation corresponding to aging of the entire display panel is difficult. However, the voltage limiters operate at levels corresponding to light-emitting efficiencies of the EL elements of R, G, and B. For this reason, the color balance can be kept preferable even after time T1.

In the embodiment described above, the zener diodes are arranged between the sample hold circuits and the DC-DC converters. However, even though the zener diodes are arranged on the input sides of the sample hold circuit or on the output sides of the DC-DC converters, the same operation effect as described above can be obtained.

In the embodiment, the zener voltages of the zener diodes are selected to operate the voltage limiters to output from the converters. However, according to the configuration shown in FIG. 5, the zener voltages use the equal zener diodes to change a setting of the reference voltage Vref supplied to the error amplifier 8 in the switching control circuit 7, so that the voltage limiter levels of converter outputs can be set at different values.

Figure 8:
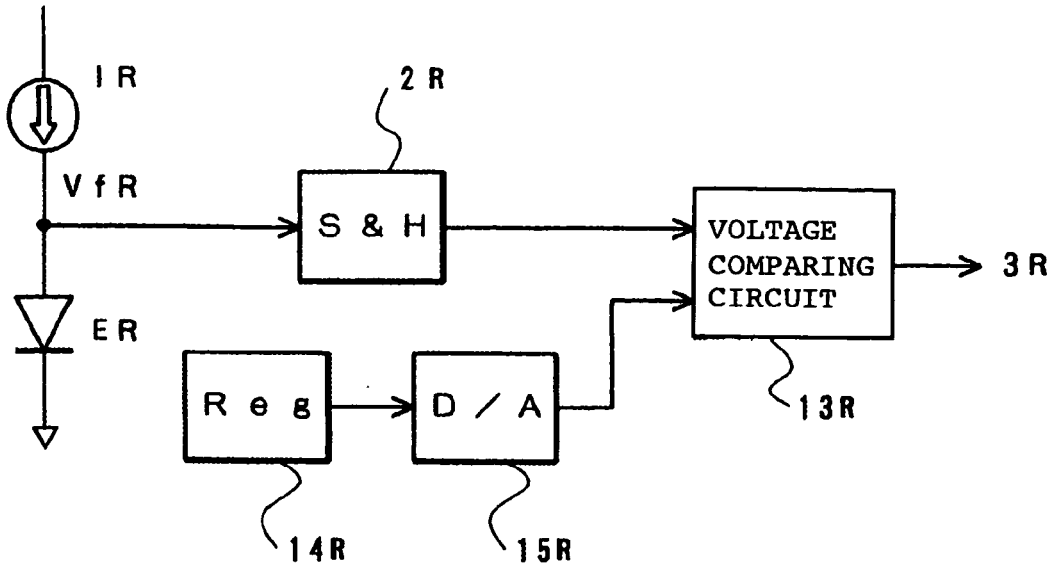
FIG. 8 is a circuit diagram showing a first example of another voltage limiter means alternative to a zener diode.
Figure 9:
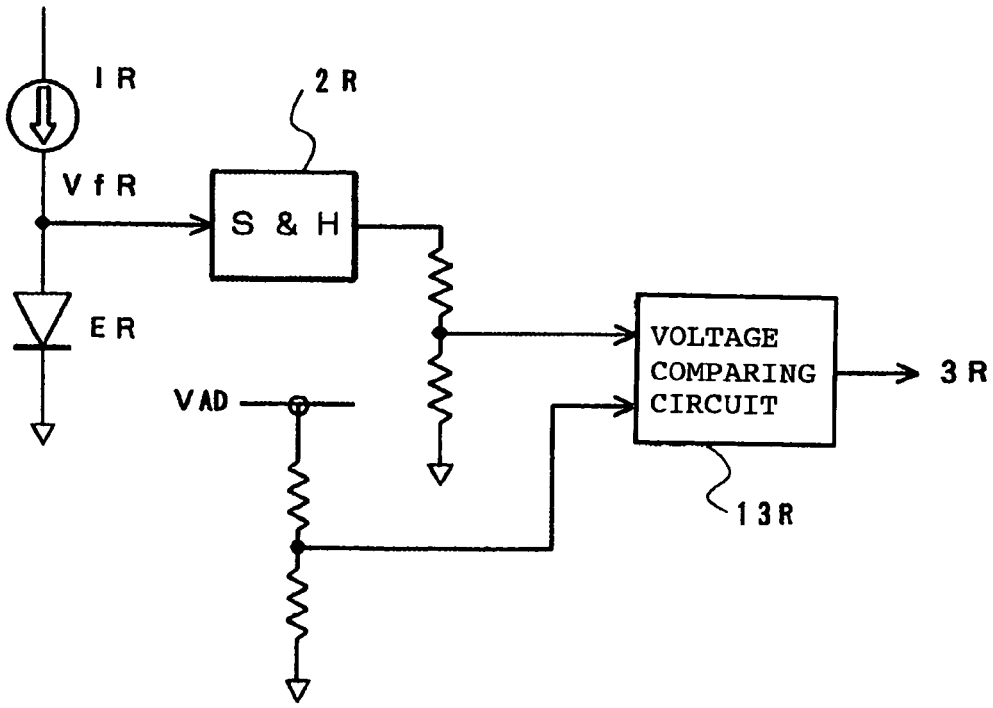
FIG. 9 is a circuit diagram showing a second example of the voltage limiter means.

FIGS. 8 and 9 show configurations of other voltage limiters alternative to the zener diodes. FIG. 8 shows the first example. In this case, FIG. 8 shows a configuration of the voltage limiter means corresponding to R. Reference symbols IR, ER, and 2R in FIG. 8, as described with reference to FIGS. 4 and 5, denote a constant current source, a monitor element, and a sample hold circuit.

In the configuration shown in FIG. 8, the forward voltage VfR of the monitor element ER held by the sample hold circuit 2R is designed to be supplied to one input terminal of a voltage comparing circuit 13R. In addition, a register 14R in which predetermined voltage data is stored and a D/A converter 15R which converts digital data from the register into an analog voltage are arranged. An analog voltage from the D/A converter is designed to be supplied to the other input terminal of the voltage comparing circuit 13R.

The voltage comparing circuit 13R functions to perform a limiter operation to the forward voltage VfR from the sample hold circuit 2R depending on the analog voltage from the D/A converter 15R to output a voltage from the voltage comparing circuit 13R. An output from the voltage comparing circuit 13R is designed to be supplied to the DC-DC converter 3R as a control voltage. More specifically, the output from the voltage comparing circuit 13R is designed to be supplied to the base electrode of the transistor Q2 shown in FIG. 5.

Therefore, according to the configuration shown in FIG. 8, the voltage data stored in the register 14R is changed to make it possible to adjust the limiter level. Optimum limiter levels corresponding to the colors R, G, and B can be respectively set.

FIG. 9 shows a second example of the other voltage limiter means alternative to the zener diode. The same reference numerals as in FIG. 8 denote parts having the same functions in FIG. 9. In the example shown in FIG. 9, the forward voltage VfR of the monitor element ER held by the sample hold circuit 2R is divided by two resistors connected in series with each other. The divided voltages are designed to be supplied to one input terminal of the voltage comparing circuit 13R. In addition to this, a voltage from a voltage source VAD is divided by two resistors connected in series with each other. The divided voltages are designed to be supplied to the other input terminal of the voltage comparing circuit 13R.

The voltage comparing circuit 13R functions to perform a limiter operation to the forward voltage VfR held by the sample hold circuit 2R depending on the divided voltage from the voltage source VAD to output the limited forward voltage VfR from the voltage comparing circuit 13R. An output from the voltage comparing circuit 13R is designed to be supplied to the DC-DC converter 3R as a control voltage. More specifically, the output from the voltage comparing circuit 13R is designed to be supplied to the base electrode of the transistor Q2 shown in FIG. 5.

Therefore, as also in the configuration shown in FIG. 9, the voltage of the voltage source VAD or a ratio of voltage-dividing resistors of the voltage source VAD is adjusted to make it possible to adjust the limiter levels. The optimum limiter levels corresponding to the colors R, G, and B can be respectively set.

According to the embodiment described above, since predetermined currents from the constant current sources are supplied to the monitor elements, the monitor elements associates light-emitting operations. Therefore, the arrangement region b of the monitor elements on the display panel 1 is desired to be covered with a light-shielding mask or the like (not shown) which shields the arrangement region b from light emitted from the monitor elements.

In the embodiment, the organic EL elements are used as display and monitor elements arranged on the display panel. However, even though other light-emitting elements having the aging and the temperature dependence shown in FIGS. 2A to 2D are used, the same operation effect can be enjoyed.

What is claimed is:

1. A device for driving a light-emitting display panel in which a large number of light-emitting elements which exhibit different emission colors are arranged as display elements and selectively luminescently driven to display an image, comprising:

monitor elements of respective colors to measure forward voltages of the light-emitting elements in display pixels of the emission colors; drive voltage control means which controls drive voltages supplied to the display pixels of the emission colors based on the forward voltages obtained by the monitor elements of the emission colors; and voltage limiter means which regulate the drive voltages from the drive voltage control means, and wherein regulation levels of the drive voltages by the voltage limiter means comprise, at least two different values.

2. The device for driving a light-emitting display panel according to claim 1, wherein the voltage limiter means are constituted by zener diodes having different zener voltages.

3. The device for driving a light-emitting display panel according to claim 1, wherein the voltage limiter means is constituted by a register, a D/A converter which converts digital data from the register into an analog voltage, and a voltage comparing circuit having one input terminal to which the analog voltage from the D/A converter is supplied, and the voltage limiter means is designed to use a limiter function between the other input terminal of the voltage comparing circuit and an output terminal.

4. The device for driving a light-emitting display panel according to claim 1, wherein the voltage limiter means is constituted by a voltage source and a voltage comparing circuit having one input terminal to which a voltage from the voltage source is supplied, and the voltage limiter means is designed to use a limiter function between the other input terminal of the voltage comparing circuit and an output terminal.

5. The device for driving a light-emitting display panel according to any one of claims 1 to 4, wherein the drive voltage control means are constituted by switching regulators which boost voltages of primary power sources to supply the boosted voltages to the display pixels of the respective colors.

6. The device for driving a light-emitting display panel according to claim 1, wherein the light-emitting elements constituting the display pixels and the monitor elements are formed on the same light-emitting display panel respectively.

7. The device for driving a light-emitting display panel according to claim 1, wherein the display pixels include light-emitting elements which emit R (Red), G (Green), and B (Blue) lights, respectively.

8. The device for driving a light-emitting display panel according to claim 1, wherein the light-emitting elements and the monitor elements in the display pixels are organic EL elements each including at least one light-emitting function layer consisting of an organic material.

9. A method for driving a light-emitting display panel in which a large number of light-emitting elements which exhibit different emission colors are arranged as display elements and selectively luminescently driven to display an image, comprising:

a forward voltage acquiring step of acquiring voltages corresponding to forward voltages of the light-emitting elements in display pixels of the colors by monitor elements of respective colors; and a drive voltage control step of generating drive voltages supplied to the display pixels of the colors based on the voltages obtained in the forward voltage acquiring step and supplying the drive voltages to the display pixels when maximum values of the drive voltages supplied to the display pixels of the emission colors are regulated to at least two different levels.

10. The method for driving a light-emitting display panel according to claim 9, wherein in the drive voltage control step, an operation of regulating the maximum values of the drive voltages is executed by a zener diode.

11. The method for driving a light-emitting display panel according to claim 9, wherein in the drive voltage control step, a configuration constituted by a register, a D/A converter which converts digital data from the register into an analog voltage, and a voltage comparing circuit having one input terminal to which the analog voltage from the D/A converter is supplied is used, and an operation of regulating the maximum value of the drive voltages is executed by using a limiter characteristic between the other input terminal of the voltage comparing circuit and an output terminal.

12. The method for driving a light-emitting display panel according to claim 9, wherein in the drive voltage control step, a configuration constituted by a voltage source and a voltage comparing circuit having one input terminal to which a voltage from the voltage source is supplied is used, and an operation of regulating the maximum value of the drive voltages is executed by using a limiter characteristic between the other input terminal and an output terminal of the voltage comparing circuit.

* * * * *